United States Patent [19]

Katz

[11] Patent Number: 5,029,820

[45] Date of Patent: Jul. 9, 1991

[54] WEDGE-ADJUSTABLE BASE FOR RAIL POSTS AND THE LIKE

[75] Inventor: Howard S. Katz, Riegelsville, Pa.

[73] Assignee: Robern, Inc., Bensalem, Pa.

[21] Appl. No.: 389,418

[22] Filed: Aug. 4, 1989

[51] Int. Cl.[5] ..... E04H 17/14

[52] U.S. Cl. ..... 256/59; 403/369; 403/370; 256/70

[58] Field of Search ..... 256/59, 65, 70; 403/369, 370, 199, 192; 52/298

[56] References Cited

U.S. PATENT DOCUMENTS 1,785,171 12/1930 Adams et al. ..... 403/370 X
2,954,638 10/1960 Motter ..... 52/298 X
3,400,905 9/1968 Van Dusen, Jr. ..... 403/369
3,579,936 5/1971 Andersson et al. ..... 403/369 X
4,363,467 12/1982 Bos ..... 256/59 X

*Primary Examiner*—Andrew V. Kundrat
*Attorney, Agent, or Firm*—Robert C. Podwil

[57] ABSTRACT

An adjustable base for use with a rail post or section provides an upwardly facing socket portion and an adjustable wedge element associated with the socket portion. A screw associated with the wedge element and the base serves to adjust the position of the wedge relative to the base and to project the wedge into engagement with a post received in the socket portion.

5 Claims, 3 Drawing Sheets

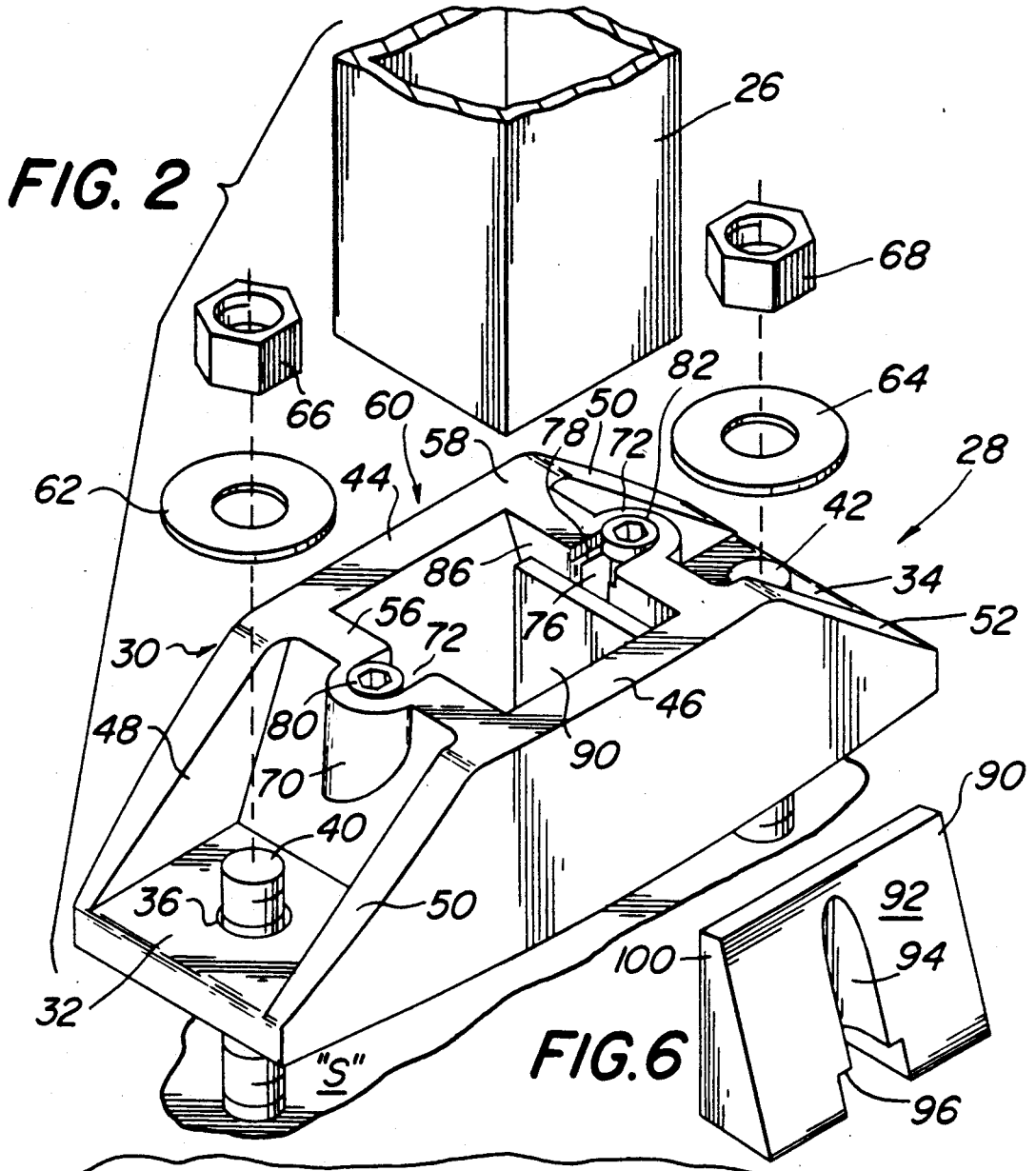
FIG. 2
26
68
66
64
62
60
58
50
82
78
72
44
28
42
86
34
52
56
72
76
30
46
48
80
90
70
40
36
50
32
"S"
FIG. 6
90
92
94
100
96
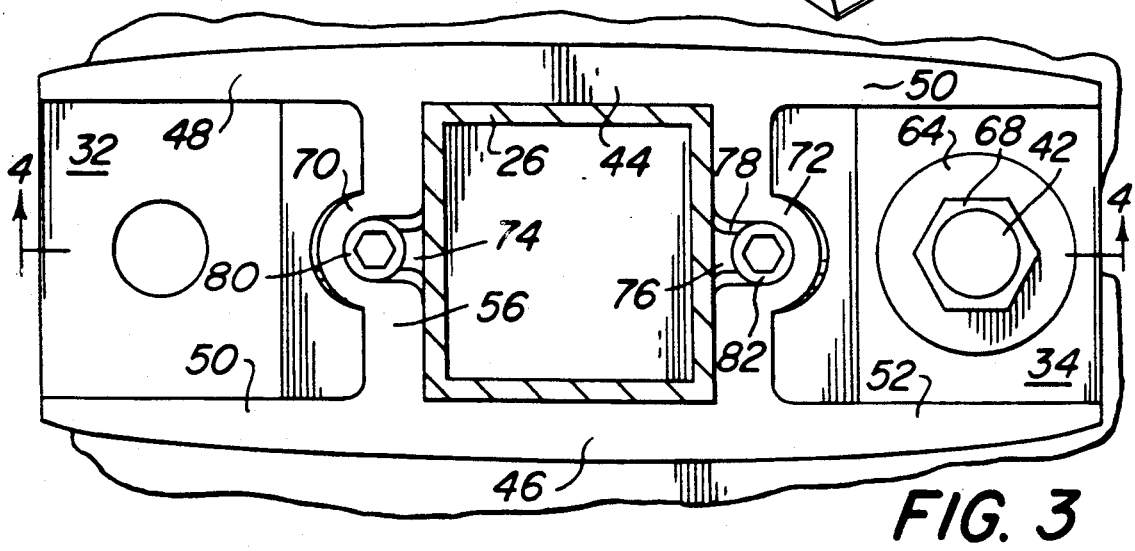
50
32
48
4
70
26
44
78
72
64
68
42
4
74
80
56
76
82
50
52
34
46
FIG. 3

WEDGE-ADJUSTABLE BASE FOR RAIL POSTS AND THE LIKE

BACKGROUND OF THE INVENTION

This invention relates to a wedge-adjustable base for a stair rail system, and more particularly, to a base for a rail system of the type made from standardized components, capable of use in stairwells and on landings and balconies. A desirable attribute of such bases is the ability to accommodate with structural stability and ease of installation a range of unevenness or inexactitude (whether designed or accidental) encountered in field conditions. Dealing with different angles of stair rake, different rail post dimensions, and irregularities in surrounding construction is a challenging requirement for components intended for use in standardized rail systems.

A rail system with which the present invention may be used to advantage is described in the applicant's copending application Ser. No. 354,946, assigned to the assignee of the present application.

BRIEF SUMMARY OF THE INVENTION

In general, rail systems with which the present invention is most useful, include prefabricated sections having an upper rail (which serves as a hand rail), a lower rail and upright pickets or posts. Some of the posts may be floor-engaging newel posts, to which the upper and lower rails are affixed. The rail sections may be made up of plural horizontal or raked rail sections, and where desired and appropriate, rail sections may be coupled to newel posts by standardized connectors.

Selected posts may advantageously be mounted in a base in accordance with the present invention, the base being anchored to the fixed structure with which the rail system is associated. The base preferably provides the decorative appearance usually associated with an escutcheon cover, while serving primarily as a structural base connection. As will be explained, the base selectively provides for fine adjustments to accommodate variations in post position and angle, again to accommodate unevenness in the structure with which the rail and base are associated or accumulated tolerances.

BRIEF DESCRIPTION OF DRAWINGS

FIG. 2 is an exploded perspective view of a base in accordance with the invention.

FIG. 3 is a top plan view of a base in accordance with the invention.

FIG. 6 is a detail view of a component of a base in accordance with the invention.

DETAILED DESCRIPTION

Figure 1:
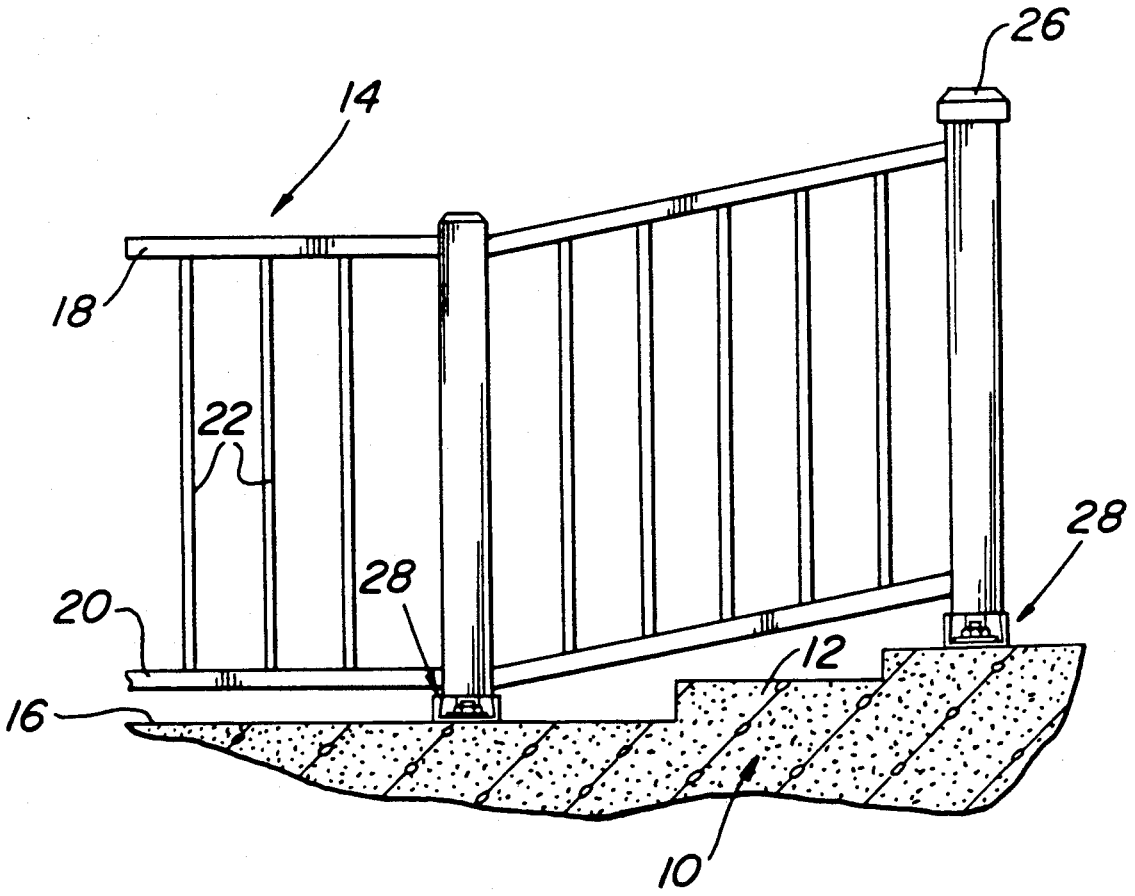
FIG. 1 is a side elevation view of an exemplary rail system in accordance with the invention.

Referring now to the drawings in detail, wherein like reference numerals indicate like elements, there is seen in FIG. 1 a rail system designated generally by the reference numeral 10. For purposes of illustration, the rail system 10 is shown in relation to a flight 12 of stairs. Associated with the rail system 10, for the purpose of illustration, is a horizontal rail section sub-assembly 14 associated, for the purposes of illustration, with a level balcony or 16 ramp.

The illustrated rail system 10 simulates a wooden picket type rail, and each of its sections consists of a hollow rail 18, which serves as a handrail, and a lower or bottom rail 20, interconnected by uprights or pickets 22 at spaced locations. Arranged to support the rail section 14 are posts 24, which may, where appropriate or desired, be newel posts such as the illustrated newel post 26.

Referring now to FIGS. 2 through 6, a base in accordance with the present invention and suitable for use in the rail system 10 will be described in detail.

Referring first to FIG. 2, the base, designated generally by the reference numeral 28, comprises a cast body portion, designated generally by the reference numeral 30. The body portion 30 is typically cast from metal such as aluminum or iron, but it could also be made from structurally suitable non-metallic (polymeric) material. The body portion 30 includes generally horizontally extending ground-engaging flanges 32 and 34, provided with respective vertically oriented openings 36 and 38 (the latter seen in FIGS. 4 and 5) adapted to receive anchor bolts 40 and 42. The anchor bolts 40 and 42 are secured at their lower ends to the support surface "S" with which the base 28 is to be associated. The base 28 is so configured as to provide upstanding side wall portions 44 and 46, extensions of which define flanged portions 48 and 50 associated with the flange 32 and flanged portions 50 and 52 associated with the flange 34.

The wall portions 44 and 46, in association with transverse wall portions 56 and 58 extending between the side wall portions 44 and 46, define an upstanding socket, designated generally by the reference numeral 60, adapted to receive the lower end of a post, such as the newel post 26.

Figure 4:
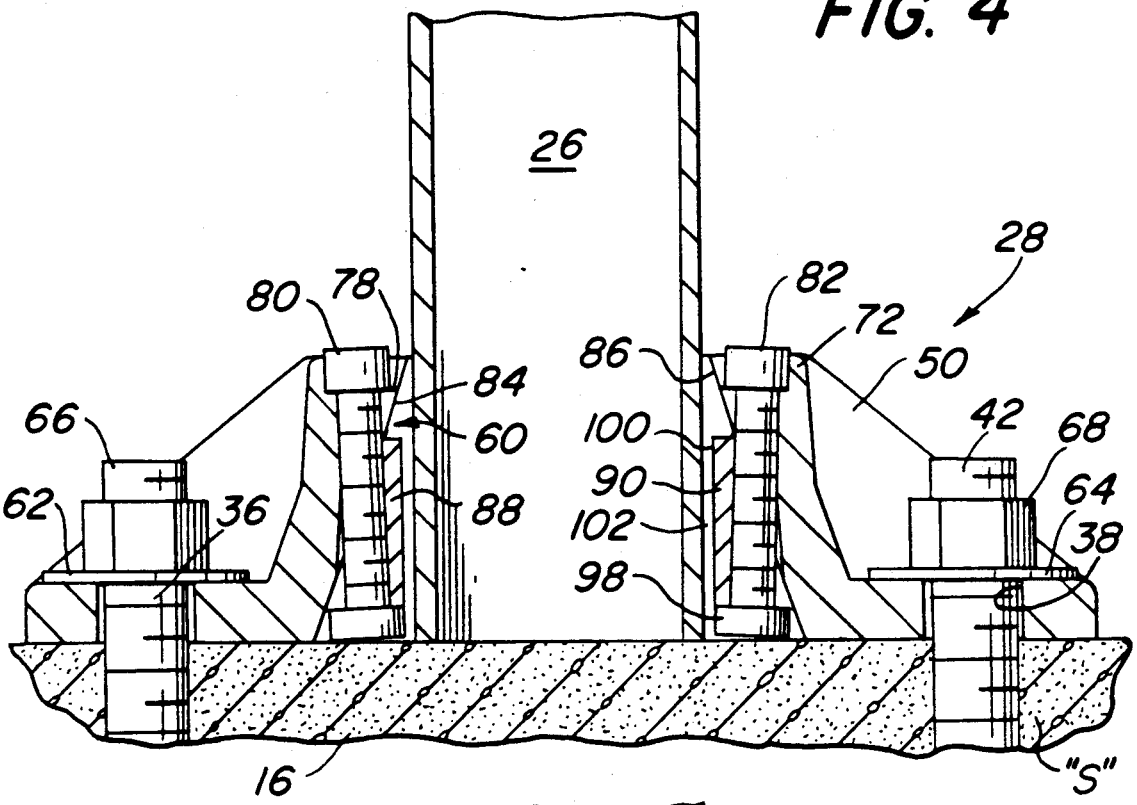
FIGS. 4 and 5 are cross-sectional views, in elevation, taken along the line 4—4 in FIG. 3.
Figure 5:
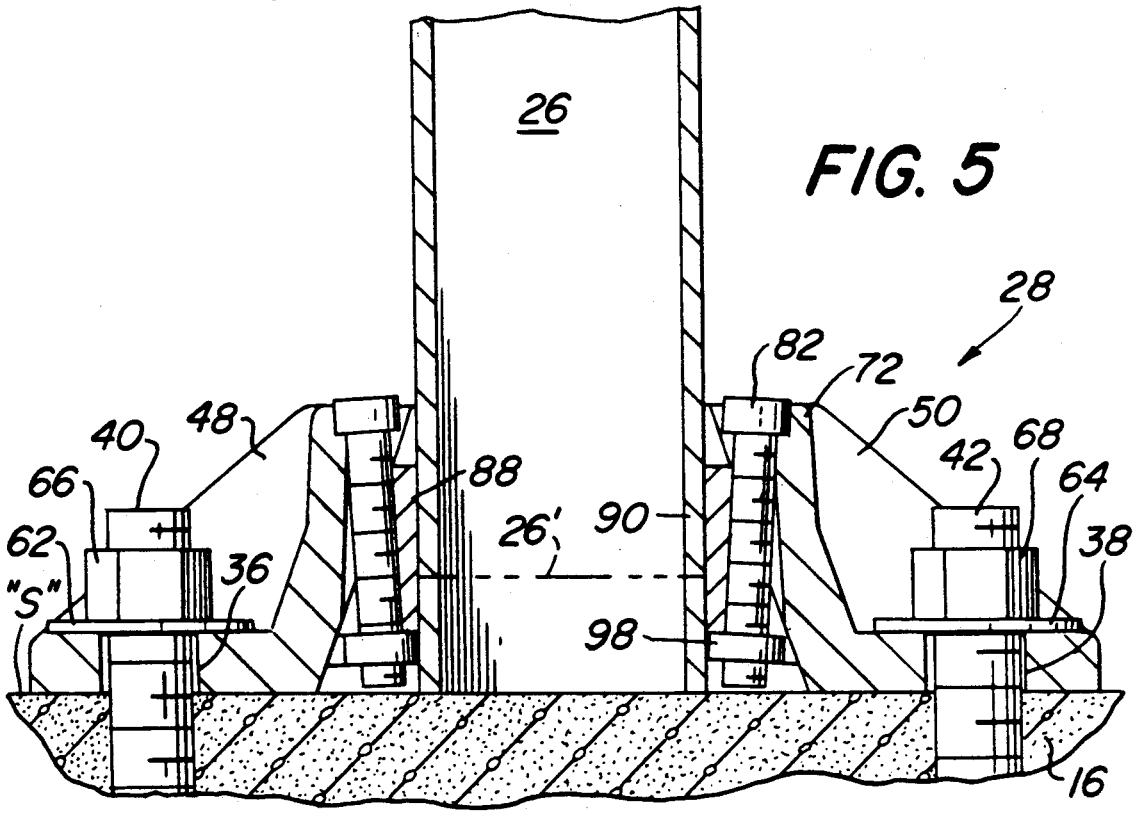

Referring to FIGS. 4 and 5, it will be seen that the base 28 may be secured to a support surface "S" provided by a fixed structure, such as the above-mentioned balcony or ramp 16, by positioning the base 28 with respect to the support surface "S" so that the anchor bolts 40 and 42 extend through the respective openings 36 and 38 in the flanges 32 and 34. Suitable washers 62 and 64 and nuts 66 and 68 are associated with the anchor bolts 40 and 42. Tightening of the nuts 66 and 68 with respect to the anchor bolts 40 and 42 secures the base 28 to the support surface "S".

Referring again to FIGS. 2 through 4, certain details of the above-mentioned socket 60 will now be more particularly described.

Referring to FIGS. 2, 4 and 5, it will be seen that, although the side walls 44 and 46 of the base 28 are generally vertically oriented, the transverse wall portions 56 and 58 are disposed at an oblique angle to the vertical.

The transverse wall portions 56 and 58 are provided with generally vertically oriented bases 70 and 72 and open-walled slots 74 and 76. The slots 74 and 76, which are juxtaposed to each other in the illustrated embodiment, terminate in horizontally disposed lands 78, adapted to receive and support the heads of cap screws, such as the cap screws 80 and 82 seen in FIGS. 2 through 6.

The oblique inner walls of the transverse wall portions 56 and 58 provide respective obliquely disposed cam surfaces 84 and 86, the function of which will now be described.

Referring to FIGS. 2 and 6, received in the socket 60, in association with the cam surfaces 84 and 86, are wedges 88 and 90, of which the wedge 90 seen in FIG. 6 is typical.

Referring now to FIG. 6, the wedge 90 has a surface 92 complemental with the cam surface 86 defined by the transverse wall portion at 58. As is apparent from FIGS. 4 and 5, due to the interaction of the cam surfaces 92 and 86, vertical movement of the wedge 90 with respect to the transverse wall portion 58 of the base 28 also causes the wedge 90 to translate horizontally toward the interior of the socket 60. With a post 26 disposed within the socket 60, such movement, and similar movement of the like-configured wedge 88, can be exploited to secure the post 26 within the socket 60, to position the post 26 vertically with respect to the base 28 and support surface "S", and also, within a small range, position the post 26 horizontally with respect to the base 28.

To facilitate adjustment and positioning of the wedge 90 with respect to the socket 60, the wedge 90 is provided with an open-walled slot 94, partly of generally circular cross-section. Associated with the slot 94 is a land 96, adapted as is apparent in FIGS. 4 and 5, to receive a nut 98. It should now be apparent that a cap screw 82 received in the slot 76 of the wall portion 58 may project into association with the slot 94 of the wedge 90, and that a nut 98 associated with the cap screw 82, received in the land 96 of the wedge 90, may serve to drive the wedge 90 upwardly upon proper rotation of the cap screw 82, so as to cause relative movement of the cam surfaces 92 of the wedge and 86 of the wall portion 58 and camming of the wedge 90 toward the center of the socket 60.

The surface 100 of the wedge 90 opposite the cam surface 92 is so angularly disposed with respect to the cam surface 92 as to be generally vertically disposed when the cam surfaces 92 and 86 are in engagement. In this regard, it has been found that by angling the surface 100 of the wedge 90 slightly more acutely (on the order of 1–3 degrees) with respect to the cam surface 92 of the wedge 90 than the angle needed to cause the surface 100 to be plumb, a desirable degree of "play" sufficient to permit slight adjustment of the post 26 and rail section 14 from the vertical is introduced.

Referring now to FIG. 4, a post 26 is seen disposed as it would be upon initial insertion into the socket 60. Clearance 102 exists between the post 26 and the surface 100 of the wedge 90. It should now be apparent that once the post 26 is positioned within the socket 60, adjustment of the cap screw 82 to draw the nut 98 upwardly may serve to lift the wedge 90 to the position seen in FIG. 5, in which the wedge is projected into abutment with a surface of the post 26. Similar adjustment of the cap screw associated with the wall portion 56 causes the post 26 to be, in effect, clamped between the wedges 88 and 90 and securely held in the base 28.

As is depicted by the dotted line in FIG. 5, adjustment of the wedges 88 and 90 can serve to compensate for unevenness or inaccuracy in the surface "S" and fixed structure with which the base 28 is associated or in the manufacture of the rail section 14 or post 26. Referring to FIG. 5, it should be apparent that if it is expedient to secure the post 26 to the base 28 at a height other than the height defined by the length of the post 26 as manufactured, the post may be adjusted longitudently within the socket 60 and secured by the wedges 88 and 90 as before. The horizontal dotted line in FIG. 5, designed by the reference numeral 26, depicts such a situation.

It should also be apparent that by selective differential adjustment of the cap screws associated with the wedges 88 and 90, one of the wedges 88 and 90 can be made to project more than the other into the socket 60. In such an arrangement, the post 26 may selectively be positioned longitudinally with respect to the base, to accommodate inaccuracy in the placement of the base 28 relative to the surface "S" or in the manufacture of the rail section 14. Judicious adjustment of the wedges 88 and 90 can also compensate for small unintended angular offsets between the post 26 and base 28, again due to inaccuracies in manufacturing or construction.

Although described above in connection with a rail system, it should be understood that the base 28 may be used to support other generally vertically oriented structural members. The various features of the above-described apparatus provides a simple, effective and relatively inexpensive base member, capable easy assembly, notwithstanding design differences in particular applications or the range of building tolerances which may be encountered in field applications.

The present invention may be embodied in other specific forms without departing from its spirit or essential attributes. Accordingly, reference should be made to the attended claims rather than the foregoing specification as an indication of the scope of the invention.

I claim:

1. A base for a rail post or the like, comprising a base portion having a flange adapted to rest on a support surface; an upwardly opening socket portion coupled to said base portion and adapted to receive a rail post; a cam surface disposed in said socket portion said socket portion comprising a spaced and juxtaposed pair of obliquely angled generally upwardly extending walls, said walls having respective cam surfaces thereon; wedges disposed in said socket portion and having surfaces thereon juxtaposed to and operatively engaged with said cam, surfaces and a surface thereon adapted to engage a post received in said socket portion; and means coupled to said base and said wedges for selectively adjusting said wedges relative to said base, adjustment of said means coupled to said base and said wedges causing said wedges to engage a surface of the post to secure the post to said portion; said means for selectively adjusting said wedges comprising a threaded member, rotation of said threaded members causing translation of said wedges with respect to said respective cam surfaces; said threaded members comprising elongated cap screws and said wedges having relieved slots adapted to receive said cap screws, and surfaces of said wedges intersecting said slots, said surfaces being adapted to receive nuts, whereby rotation of said cap screws causes said nuts to move said wedges.

2. A base in accordance with claim 1, and spaced openings in said flange to facilitate said coupling of said base to a support surface.

3. A base for a rail post of the like, comprising a foot portion adapted to rest on a support surface; a socket portion associated with said foot portion and extending upwardly therefrom, said socket portion adapted to receive the lower end of the rail post and having a pair of vertically disposed walls and a pair of obliquely upwardly disposed cam surfaces angularly disposed with respect to said vertically disposed walls and angled inwardly toward the upper end of said socket portion; wedges disposed in said socket portion and having angled surfaces thereof complemental with said cam surfaces whereby sliding movement of said wedges with respect to said cam surfaces causes selective projection or retraction of said wedges with respect to said socket portion, said wedges having generally vertically disposed surfaces thereon opposite said angled surfaces adapted to engage a post received in said socket portion, said socket portion having a width in excess of the width of said post, so that relative adjustment of said wedges can compensate for unevenness of the support surface to secure the rail post in a vertical orientation.

4. A rail system comprising a rail section having at least one horizontal rail and a vertical post coupled to said rail, and an adjustable base for said rail section, said base comprising a foot portion adapted to rest on a support surface; a socket portion associated with said foot portion and extending upwardly therefrom, said socket portion adapted to receive the lower end of said post and having a pair of vertically disposed walls and a pair of spaced and juxtaposed obliquely upwardly disposed cam surfaces angularly disposed with respect to said vertically disposed walls and angled inwardly toward the upper end of said socket portion; a pair of wedges disposed in said socket portion and having angled surfaces thereof complemental with said cam surfaces whereby movement of said wedges with respect to said cam surfaces causes selective projection or retraction of said wedges with respect to said socket portion, said wedges having generally vertically disposed surfaces thereon opposite said angled surfaces adapted to engage said post, and said socket portion having a width in excess of the width of said post, so that adjustment of said wedges can compensate for unevenness in the support surface.

5. A rail system in accordance with claim 4, wherein said angled surfaces of said wedge complemental with said cam surface are so angled that said generally vertically disposed surface is offset from the vertical by about 1–3 degrees.

* * * * *